United States Patent [19]

Itoh et al.

[11] 3,962,071

[45] June 8, 1976

[54] PROCESS FOR PRODUCING LUBRICATING OILS

[75] Inventors: Takuji Itoh; Tadashi Miura; Ikuo Akitsuki, all of Ohi, Japan

[73] Assignee: Toa Nenryo Kogyo Kabushiki Kaisha, Tokyo, Japan

[22] Filed: May 13, 1974

[21] Appl. No.: 469,417

[30] Foreign Application Priority Data

May 19, 1973 Japan ..... 48-55765

[52] U.S. Cl. ..... 208/58; 208/18; 208/143; 208/264; 252/454; 252/455 R; 260/690

[51] Int. Cl.[2] ..... C10G 37/06; C10G 23/04

[58] Field of Search ..... 208/58, 18, 264, 143, 208/144; 252/455 R, 454; 260/690

[56] References Cited

UNITED STATES PATENTS

| | | | |
|---|---|---|---|
| 3,487,005 | 12/1969 | Egan et al. | 208/59 |
| 3,530,061 | 9/1970 | Orkin et al. | 208/60 |
| 3,551,325 | 12/1970 | Rausch | 208/89 |
| 3,629,096 | 12/1971 | Divijak | 208/89 |
| 3,794,580 | 2/1974 | Ladeur | 208/110 |
| 3,852,207 | 12/1974 | Stangeland et al. | 208/58 |
| 3,876,522 | 4/1975 | Campbell et al. | 208/58 |

*Primary Examiner*—Delbert E. Gantz
*Assistant Examiner*—G. E. Schmitkons
*Attorney, Agent, or Firm*—Reuben Miller

[57] ABSTRACT

A process for producing lubricating oils of enhanced photostability by hydrogenating a lubricating oil fraction of a hydrocrackate in the presence of a palladium catalyst supported on a silica-containing refractory inorganic oxide carrier in which the silica content is less than 40 weight %.

7 Claims, No Drawings

PROCESS FOR PRODUCING LUBRICATING OILS

This invention relates to a process for producing lubricating oils, particularly to a process for producing high quality lubricating oils having improved stability in the presence of light and oxygen (hereafter referred to as "photo-stability"). More specifically, this invention is directed to a process for producing lubricating oils having improved photo-stability by the method of hydrotreating hydrocarbon oil fractions having lubricating oil viscosity which are derived from the hydrocrackate of heavy hydrocarbon oils.

Conventionally a general process for producing lubricating oils comprises solvent extraction, dewaxing, acid-treating, clay-treating, hydrofinishing, etc., of lubricating oil fractions obtained by atmospheric or vacuum distillation. Hydrofinishing has been employed as a process for obtaining lubricating oils with improved color stability under less severe conditions than are employed in acid-treating or clay treating. In order to obtain high Viscosity Index (V.I.) lubricating oils by such a series of refining processes as mentioned above, it is required that the solvent extraction be performed under severe treating conditions which sufficiently remove low Viscosity Index fractions consisting mainly of aromatic hydrocarbons. The product yield from solvent extraction is too low to obtain commercial quantities of high Viscosity Index lubricating oils and furthermore the Viscosity Index level of such treated oils, even when obtained by the use of very severe treating conditions, is of such levels so as to require large amounts of Viscosity Index improvers. As a result a process for producing more industrially valuable lubricating oils is becoming of importance when considering the increasing need for high quality lubricating oils with a high Viscosity Index. Recently a process for producing high Viscosity Index lubricating oil fractions by hydrocracking heavy hydrocarbon oils has been developed to cope with the problem mentioned above. The process for producing lubricating oils by the hydrocracking of heavy hydrocarbon oils comprises a process to separate lubricating oil fractions from the hydrocrackate obtained by contacting heavy hydrocarbon oils with hydrogen in the presence of a hydrocracking catalyst under high temperature and high pressure reaction conditions such as for example a reaction temperature of about 340°C. and a reaction pressure of more than about 150 kg/cm$^2$. By employing the above described hydrocracking reaction, lubricating oil fractions can be obtained having Viscosity Index levels higher and sulfur and nitrogen levels lower than the products obtained by means of the solvent extraction procedure mentioned above.

However, the photo-stability of the lubricating oils separated from the hydrocrackate so produced is not good. That is, a haze of cloud-like condensate initially occurs followed by the formation of sludge or sediment, etc., when the oils are exposed to air or in the presence of oxygen. This effect reduces the commercial value of such lubricating oils and prevents their perfect function as lubricants.

The reason for such instability upon exposure to air or oxygen is not fully known but possibly may be explained as resulting from aromatic hydrocarbon saturation or ring hydrogenation, decyclization, splitting off of side chains of aromatic rings, etc., occuring during the hydrocracking reaction of hydrocarbons so as to form a small amount of unstable aromatic hydrocarbons which in the presence of light will react with the oxygen in air to form insoluble oxygen-containing compounds which precipitate as sludge.

Various methods for improving the photo-stability of hydrocrackate lubricating oil fractions have been disclosed in the art, such as for example the extraction of such fractions with a polar solvent or the hydrofining of such fractions. All of these prior known methods show low yield of the refined oils and disadvantges in catalytic activity and catalytic life, etc., which lowers the incentive for their use as industrial processes for producing high quality lubricating oils.

Accordingly, it is an object of the present invention to provide an improved process for the preparation of high quality lubricating oils having a high Viscosity Index and excellent photo-stability.

In accordance with the present invention, this objective is unexpectedly accomplished by the contacting with hydrogen of lubricating oil fractions, separated from a hydrocrackate of a heavy hydrocarbon oil, in the presence of a catalyst comprising palladium supported on a refractory inorganic oxide containing less than about 40 weight % of silica.

In more detail, the present invention pertains to a process for producing lubricating oils comprising the steps of (1) separating hydrocarbon oil fractions having lubricating oil viscosity from the product obtained by contacting hydrocarbon oils having kinematic viscosity of more than about 3 cst. at 98.9° C. with hydrogen under hydrocracking conditions in the presence of a hydrocracking catalyst, followed by contacting said hydrocarbon oil fractions with hydrogen of from about 30 to 3,000 Nm$^3$/kl in the presence of a palladium catalyst with refractory inorganic oxide carrier containing less than about 40% by weight of silica under conditions which comprise a reaction temperature ranging from about 100° to 400°C., a reaction pressure of more than about 10 kg/cm$^2$, and a liquid hourly space velocity of less than about 10 V/H/V.

While any hydrocarbon oil fraction having lubricating oil viscosity can be used as a feedstock for the treatment with hydrogen in the presence of the above described palladium catalyst, hydrocarbon oil fractions having a boiling point of higher than about 350°C. are preferred.

The supported palladium catalyst used in the hydrogenation process exhibits high sulfur resistance so that the hydrocarbon oil fractions with lubricating oil viscosity separated from hydrocrackate can be used as hydrogenation feedstocks without any pre-treatment. However, hydrofining pre-treatment of such feedstocks to remove sulfur and nitrogen is preferably employed before hydrogenation.

The hydrocarbon oils suitably used as feedstocks for the hydrocracking used in this invention comprises hydrocarbon oils having kinematic viscosity of more than about 3 cst. at 98.9°C., preferably vacuum distillates, residuums or deasphalted oils, or other heavy oils, or mixtures thereof, the kinematic viscosity of which ranges from about 3 to 200 cst. at 98.9°C. Atmospheric distillates can be also employed as a mixture component.

The hydrocracking catalyst used in the hydrocracking process for preparing the feedstocks of the present invention are those well known in the art. These generally contain components having both hydrogenation and cracking activity such as for example one or more components having hydrogenating activity on a support containing an active cracking component such as for example, silica. Components having hydrogenating activity comprise the metals of Group VI and/or Group VIII of the Periodic Table, their oxides and/or sulfides and mixtures thereof. Generally, the Group VI metals include chromium, molybdenum or tungsten and mixtures of these metals while the Group VIII metals commonly employed are iron, cobalt, nickel, palladium, platinum, rhodium, osmium, iridium and mixtures of these metals. Preferably, the active hydrogenation component comprises a mixture or combination of one or more Group VI metal with one or more Group VIII metal, the combinations of nickel-molybdenum, cobalt-molybdenum, nickel-tungsten, nickel-cobalt-molybdenum being particularly preferred.

The active cracking component comprises a silica-containing refractory inorganic oxide carrier material exemplified by materials such as silica-alumina, silica-zirconia, silica-magnesia, silica-alumina-magnesia, etc., with silica-alumina being the preferred carrier for use in the present invention. The inorganic oxide carrier may, if desired, contain a halogen, e.g. fluorine, chlorine, etc., as an acceleracting or activating agent. The silica content of the inorganic oxide carrier should range from about 2 to 50 weight % with a range from about 10 to 30 weight % being particularly preferred.

Generally, the hydrocracking catalyst used in the present invention will preferably contain from about 4 to 20 weight % of an oxide of a Group VI metal and from about 1 to 15 weight % of a Group VIII metal. Preferably, the hydrocracking catalyst is subjected to a sulfiding treatment before being used in the hydrocracking process. The sulfiding treatment is carrier out by contacting the catalyst with gaseous mixture of hydrogen sulfide and hydrogen or with sulfur-containing liquid hydrocarbon oils in the presence of hydrogen.

Hydrocracking reaction conditions employed in the process of the present invention include a reaction temperature ranging from about 300° to 450°C., a reaction pressure ranging from about 50 to 300 kg/cm$^2$, a liquid hourly space velocity ranging from about 0.1 to 5 V/Hr/V and a hydrogen gas flow rate ranging from about 30 to 300 Nm$^3$/kl. The hydrocracking conditions are preferably controlled to obtain a product containing more than 50 vol. % of hydrocarbon oil fractions with lubricating oil viscosity. Hydrogen may be obtained from naphtha reforming plants or any other hydrogen manufacturing plant preferably providing a hydrogen gas stream having a hydrogen content of greater than 85%.

Hydrogenation is employed to hydrogenate unstable aromatic hydrocarbons contained in hydrocarbon oils with lubricating oil viscosity separated from the hydrocrackate. The catalyst used for hydrogenation requires high hydrogenating activity to hydrogenate aromatic rings. In the process of the present invention a palladium catalyst supported by a refractory inorganic oxide having weak acidic sites and a specific silica content is used. As a refractory inorganic oxide carrier, alumina, magnesia, zirconia, titania, hafnia, boria, etc., can be employed. The most preferred carrier used in this invention, however, is alumina, to which a small amount of a refractory inorganic oxide carrier such as magnesia, zirconia, etc., can be added within the range from about 1 to 10 weight %. The silica content in the support should be less than about 40 weight %, preferably from about 5 to 40 weight %. The silica content in the carrier has an effect both on the quality of the treated oils, especially on the viscosity as well as on the sulfur resistance of the catalyst. By controlling the silica content to less than about 40 weight % the catalyst life can be prolonged due to the improvement of the sulfur resistance of the catalyst without lowering the viscosity of the treated oils, while the presence of more than about 40 weight % silica results in a lowering of the viscosity of the treated oils. Furthermore, the absence of any silica in the catalyst reduces its sulfur-resistance and lowers its hydrogenating activity so that the high quality lubricating oil product which is the object of the present invention cannot be obtained.

The silica-alumina support preferably used in this invention can be prepared by any conventional method such as a method of making a mixture of silica gel and alumina gel; or a method of impregnating silica gel with an aqueous solution of an aluminum compound, then adding therein an alkaline material to raise the pH of the mixture sufficiently so as to precipitate the alumina gel on the silica gel; or a method of adding an alkaline material to a homogeneous aqueous solution of a mixture of a silicon compound and an aluminum compound so as to coprecipitate a silica and alumina gel; etc.

The palladium can be supported on the inorganic refractory oxide carrier by any conventional method such as, for example a method of adding a palladium compound to an aqueous solution of silicon and aluminum compound and coprecipitating all three components; or a method of adding an aqueous solution of a palladium compound to the gel form of the carrier. The preferred method is that of contacting or immersing the carrier in an aqueous solution of a palladium compound and thereby impregnating the palladium compound into the carrier material. More particularly, this preferred method involves the steps of impregnating a carrier with an aqueous solution, acidic or basic, of a palladium compound; then separating the solution therefrom followed by washing, drying and calcination of the impregnated product. The drying temperature is preferably within the range from room temperature to about 150°C., the calcination temperature within the range from about 150° to 500°C. The content of palladium component in the catalyst can be within the range of a catalytically effective quantity such as in the range from about 0.1 to 1 weight % as palladium. Other reaction promoting catalyst components such as thorium, cerium, etc., may be added in the supported palladium catalyst of the present invention. The palladium catalyst supported by the silica-containing inorganic oxide carrier of the present invention has preferably the following properties:

Specific surface area of from about 100 to 500 m$^2$/g.
Pore volume of from about 0.5 to 1.2 ml/g.
Average pore radius of from about 30 to 120 A.
Bulk density of from about 0.5 to 0.7 g/ml.

The hydrogenation reaction conditions when using the supported palladium catalyst consist of a reaction temperature in the range from about 100° to 400°C., preferably from about 180° to 300°C.; a reaction pressure of more than about 10 kg/cm$^2$, preferably in the range from about 30 to 200 kg/cm$^2$; a liquid hourly space velocity in the range of from about 0.1 to 3 V/H/V. The hydrogen gas flow rate ranges from about 30 to 3,000 Nm$^3$/kl, preferably from about 50 to 2,000 Nm$^3$/kl. Although a lower reaction temperature and a higher reaction pressure are desired to convert aromatic rings into naphthenic rings by hydrogenation, the process of the present invention can be conducted under a reaction pressure of just greater than 10 kg/cm². The hydrogenation can be performed in a single or multiple reaction zones over a fixed, fluid, or moving bed catalyst.

The following description concerns the hydrofining step by which hydrogenation feedstock oils are subjected to desulfurization.

Hydrocarbon oil fractions having lubricating oil viscosity obtained from a hydrocrackate may be fed to a hydrofining process before the hydrogenation process step so as to remove sulfur and nitrogen from the oil, which results in the continuous high level catalytic activity for aromatic ring hydrogenation of the supported palladium catalyst.

The hydrofining catalyst comprises a sulfur-resistant catalyst component comprising an oxide, sulfide or mixture thereof of Group VI metals and/or Group VIII metals of the Periodic Table supported on a carrier. In the process of the present invention, any well-known hydrofining catalyst can be used. One or more metals such as, for example, molybdenum, chromium, tungsten, iron, nickel, cobalt can be used, and combinations of such metals such as molybdenum-cobalt, molybdenum-nickel, tungsten-nickel, molybdenum-nickel-cobalt, tungsten-nickel-cobalt, etc. These hydrogenating active components are preferably carried on the support as an oxide in the range of from about 4 to 20 weight % of Group VI metals of the Periodic Table and in the range of from about 1 to 15 weight % of Group VIII metals of the Periodic Table.

One or more refractory inorganic oxide carriers having low hydrocracking activity such as alumina, magnesia, diatomaceous earth, boria, thoria, etc. can be used as a carrier. Alumina, in which a small amount of silica may be contained as a stabilizer, is preferred.

The hydrofining reaction conditions used may change within a range which would depress hydrocracking and inhibit hydrocarbon conversion, and include a reaction temperature in the range of from about 180° to 350°C., preferably from about 220° to 280°C.; a reaction pressure in the range of from about 5 to 250 kg/cm², preferably from about 10 to 100 kg/cm²; a liquid hourly space velocity in the range of from about 0.3 to 10 V/H/V, preferably from about 0.3 to 2 V/H/V; and a hydrogen gas flow rate in the range of from about 10 to 1,000 Nm³/kl, preferably from about 20 to 500 Nm³/kl.

The dewaxing of the hydrocarbon oil fractions with lubricating oil viscosity separated from the hydrocrackage can be employed before or after hydrofining, or after the hydrogenation process step. Solvent dewaxing, adsorption dewaxing, press dewaxing, etc. are suitable as dewaxing processes. In solvent dewaxing, light hydrocarbons such as saturated or unsaturated hydrocarbons with carbon numbers of from 2 to 4, or mixtures thereof with ketone such as acetone, methylethylketone methylisobutylketone, can be used as a dewaxing solvent. A mixture of aromatic hydrocarbons like benzene and a ketone may be preferred. In the adsorption dewaxing, parafinic hydrocarbons are adsorbed by a crystalline zeolite with pore diameters of about 5 Å and then separated from other hydrocarbons. The dewaxing conditions have no special restrictions, and any well-known condition can be used.

It is clear from the following examples that lubricating oils having low ultraviolet absorbance are obtained by this invention. For example, UV absorbance, measured by $\log^{-1}ocm^{-1}$ unit as to ultraviolet rays, of polycyclic aromatic hydrocarbons appearing at the wave length of 279 mμ and 333 mμ can be reduced to almost zero, which shows that the polycyclic aromatic hydrocarbons are easily removed in spite of their resistance to hydrogenation.

Consequently photo-stability of lubricating oils can be remarkably improved, which is apparent from the result that the hydrogenated oils have more than 30 days before sludge formation in contrast with 3 days for crude oils, where the photo-stability is appraised using as a test basis the days to sludge when standing the sample in a glass vessel at room temperature exposed to light.

Furthermore, the supported palladium catalyst used in the hydrogenation is so sulfur-resistant that it can be used continuously during the operation. Additionally it can also be regenerated to increase its economical advantage which makes it of higher industrial value in considering operation and plant design.

As described above, this invention concerns the process for producing high quality lubricating oils in good yield by contacting with hydrogen the hydrocarbon oil fractions with lubricating oil viscosity in the presence of a palladium catalyst supported on a carrier containing less than 40 weight % of silica.

The following examples give further description of the present invention.

EXAMPLE 1

A vacuum distillate of a Middle East crude having the following properties was used as the feedstock for hydrocracking.

Properties of the Hydrocracking Feedstock

| | | |
|---|---|---|
| Specific gravity, 15/4°C. | | 0.9278 |
| Boiling range, °C. | above | 399 |
| Viscosity,cst. | | |
| at 98.9°C. | | 14.56 |
| at 37.8°C. | | 195.0 |
| Viscosity Index | | 75 |
| Sulfur, wt. % | | 2.37 |
| Nitrogen, ppm | | 823 |

The above described feed was contacted with hydrogen at a flow rate of 500 Nm³/kl over the molybdenum-nickel catalyst of Note 1 below at hydrocracking reaction conditions of a reaction pressure of 200 kg/cm², a reaction temperature of 405°C., and a liquid hourly space velocity of 1.0 V/H/V.

The resulting hydrocrackate was then subjected to vacuum distillation, whereby a fraction in the boiling range of from 389° to 471°C. was obtained. The obtained fraction was dewaxed, and then hydrofined over the cobalt-molybdenum catalyst of Note 2 below under hydrofining reaction conditions of a reaction pressure of 25 kg/cm², a reaction temperature of 300°C., a liquid hourly space velocity of 1.0 V/H/V, and a hydrogen gas flow rate of 500 Nm³/kl.

The results of the hydrofining are as follows:

Results of the Hydrofining

| | Feedstock | Hydrofined Oil |
|---|---|---|
| Specific gravity, 15/4°C. | 0.8675 | 0.8636 |
| Sulfur, ppm | 56 | 4 |
| Viscosity, cst. | | |

-continued

Results of the Hydrofining

| | Feedstock | Hydrofined Oil |
|---|---|---|
| at 98.9°C. | 5.29 | 5.21 |
| UV absorbance, $log^{-1}.cm^{-1}$ at 279 mμ | 1.050 | 1.007 |

Note 1.

Hydrocracking catalyst of NM-501 made by Nalco Chemical Co.

| | | |
|---|---|---|
| | silica-alumina (silica: | 14% by weight) |
| Molybdenum Oxide | | 13.0 % by weight |
| Nickel Oxide | | 5.7 % by weight |

Note 2.

Hydrofining Catalyst of NM-471 made by Nalco Chemical Co.

| | | |
|---|---|---|
| Base | alumina | |
| Molybdenum Oxide | | 12.5 % by weight |
| Cobalt Oxide | | 3.0 % by weight |

The hydrofined charge stock thus obtained was hydrogenated under hydrogenation reaction conditions of a reaction pressure of 55 kg/cm², a reaction temperature of 260°C., a liquid hourly space velocity of 0.5 V/H/V, and a hydrogen gas flow rate of 356 Nm³/kl over the following three kinds of supported palladium catalysts.

A sample was taken in a 100 ml. glass vessel without sealing the inlet and then kept standing at room temperature until some sludge was formed. Note was taken of the number of days required to form the sludge.

b. UV Absorbance

An auto-spectrophotometer designated as EPS-3T and made by Hitachi was used as the instrument for measuring UV absorbance. A sample graphite cell of 10 mm width was used on the measured cell. The UV absorbance was calculated according to the Lambert-Beer's equation.

From the above data it is clear that the present invention using Catalyst A reveals a substantial beneficial effect in comparison with the results obtained from Catalyst B having a high silica content, or Catalyst C using an activated carbon support.

EXAMPLE 2

A vacuum distillate was subjected to hydrocracking and hydrofining, under the same conditions as were used in Example 1. By adding dibenzothiophene to the hydrofined oil, the sulfur content thereof proved to be 7 ppm. Hydrogenation was conducted after that over catalysts A and D under the following reaction conditions.

| | Palladium, wt. % | Base | Specific Surface Area m²/g |
|---|---|---|---|
| Catalyst A | 0.5 | silica-alumina (silica: 24 wt. %) | 344 |
| Catalyst B | 0.5 | silica-alumina (silica: 75 wt. %) | 400 |
| Catalyst C | 2.6 | activated carbon | 625 |

Results are as follows:

| | Charge Stock | Catalyst A | Catalyst B | Catalyst C |
|---|---|---|---|---|
| UV absorbance, $log^{-1}.cm^{-1}$ | | | | |
| at 279 m | 1.007 | 0.0020 | 0.0049 | 0.403 |
| at 333 mm | 0.344 | 0.0001 | 0.0004 | 0.172 |
| Photo-stability, day | 2 | 70 | 37 | 3 |
| Viscosity, cst. | | | | |
| at 98.9°C. | 5.21 | 5.11 | 4.17 | 5.21 |
| at 37.8°C. | 31.7 | 31.1 | 21.9 | 31.7 |

Method of Preparation of Catalysts A, B and C (Catalyst A)

Palladium chloride was dissolved in hydrochloric acid of 0.005N. A silica-alumina carrier containing 24% by weight of silica was contacted with the palladium chloride solution so as to impregnate the palladium into the carrier. The impregnated catalyst was then subjected to filtration and washing. The washing catalyst was dried at 120°C. and calcined in a muffle furnace at 360°C. for 3 hours.

(Catalyst B)

Palladium chloride was dissolved in an aqueous solution of ammonium hydroxide of 0.1 N, and the solution was contacted with a silica-alumina carrier containing 75% by weight of silica. The impregnated catalyst was then subjected to the same processes as was Catalyst A.

(Catalyst C)

Commercially available catalyst of Kawaken Fine Chemicals Co.

Testing Method a. Photo-stability

Hydrogenation Conditions

| | |
|---|---|
| Reaction Temperature, °C. | 260 |
| Reaction Pressure, kg/cm² | 90 |
| Liquid Hourly Space Velocity, V/H/V | 0.5 |
| Hydrogen Gas Flow Rate, Nm³/kl (scf/Bbl) | 356 (2,000) |

| Catalyst | Palladium, wt.% | Base |
|---|---|---|
| Catalyst D | 0.5 | alumina |
| Catalyst A | 0.5 | silica-alumina (silica: 25 wt.%) |

The results are shown in the following:

| | Charge Stock | Treated Oil | |
|---|---|---|---|
| | Sulfur,ppm | UV Absorbance $log^{-1}.cm^{-1}$ at 280 m/μ | Photo-Stability, day |
| Catalyst D | 4 | 0.0050 | 23 |
| | 7 | 0.0453 | 9 |
| Catalyst A | 4 | 0.0048 | 33 |
| | 7 | 0.0075 | 23 |

It is apparent from the above table that catalyst A with a silica-alumina support containing more than 24 weight % of silica, in contrast with catalyst D with a support containing no silica, reveals remarkable hydrogenating activity even in the presence of a relatively high sulfur content in the oil.

EXAMPLE 3

A vacuum distillate was subjected to hydrocracking and hydrofining, under the same conditions as were used in Example 1. The hydrofined oil was then hydrogenated over the supported palladium catalysts designated as catalysts A, B, F, G, and H under the following conditions.

| Hydrogenation Conditions | |
|---|---|
| Reaction Temperature, °C. | 260 |
| Reaction Pressure, kg/cm² | 55 (Used for Catalyst A, F and G)<br>90 (Used for Catalyst H and B) |
| Liquid Hourly Space Velocity, V/H/V | 0.5 |
| Hydrogen Gas Flow Rate, Nm³kl (scf/Bbl.) | 356 (2,000) |

| Catalyst | Palladium, wt % | Base | Viscosity, cst. 98.9° C. | Viscosity, cst. 37.8° C. |
|---|---|---|---|---|
| Catalyst F | 1.0 | alumina | 5.16 | 31.4 |
| Catalyst A | 0.5 | silica-alumina (silica: 24 wt.%) | 5.11 | 31.1 |
| Catalyst G | 0.5 | silica-alumina (silica: 35 wt.%) | 5.14 | 31.0 |
| Catalyst H | 0.5 | silica-alumina (silica: 44 wt.%) | 5.07 | 30.4 |
| Catalyst B | 1.0 | silica-alumina (silica: 75 wt.%) | 4.17 | 21.9 |

Apparently from the results above the hydrogenation using the catalysts containing more than about 40 wt. % of silica (catalysts H and B) resulted in a lower viscosity of the treated oil, which shows that the silica content of the catalyst is critical for the process of the present invention.

What is claimed is:

1. A process for producing lubricating oils of enhanced photostability comprising the following steps in combination:

i. hydrocracking a hydrocarbon oil having a kinematic viscosity of more than about 3 cst. at 98.9°C. over a hydrocracking catalyst under hydrocracking reaction conditions thereby producing a hydrocrackate product containing more than about 50 volume % of hydrocarbon oil fractions having lubricating oil viscosity;

ii. fractionating said hydrocrackate to obtain at least one hydrocarbon oil fraction having lubricating oil viscosity; and iii. contacting said fraction having lubricating oil viscosity with hydrogen under hydrogenation reaction conditions comprising a reaction temperature of from about 180° to 300°C., a reaction pressure of more than about 10 kg/cm², a liquid hourly space velocity of less than about 10 V/hr/V, and a hydrogen gas flow rate of from about 30 to 3000 Nm³/kl in the presence of a hydrogenation catalyst comprising palladium supported on a silicacontaining refractory inorganic oxide carrier in which the silica content is from about 5 to less than 40 weight %, said carrier having a specific surface area of from about 100 to 500 m²/g, a pore volume of from about 0.5 to 1.2 ml/g, an average pore radius of from about 30 to 120A and a bulk density of from about 0.5 to 0.7 g/ml.

2. A process as defined in claim 1 wherein said hydrocarbon oil in step (i) has a boiling point of above about 350°C.

3. A process as defined in claim 1 wherein said hydrocarbon oil fraction having lubricating oil viscosity is contacted with hydrogen under hydrofining reaction conditions in the presence of a sulfur-resistant hydrofining catalyst before being contacted in step (iii) with hydrogen under said hydrogenation reaction conditions in the presence of said hydrogenation catalyst.

4. A process as defined in claim 1 wherein said hydrocarbon oil fraction having lubricating oil viscosity is dewaxed before being contacted with hydrogen under hydrogenation reaction conditions in the presence of said hydrogenation catalyst.

5. A process according to claim 1 wherein said hydrogenation catalyst comprises 0.1 to 1 weight % palladium on said silica-containing refractory inorganic oxide carrier.

6. A process as defined in claim 5 wherein said carrier is alumina containing from about 5 to 40 wt. % silica.

7. A process as defined in claim 5 wherein said hydrogenation reaction conditions comprise a reaction temperature in the range from about 180° to 300°C., a reaction pressure in the range from about 30 to 200 kg/cm², a liquid hourly space velocity in the range from about 0.1 to 3 V/Hr./V and a hydrogen gas flow rate in the range from about 50 to 2000 Nm³/kl.

* * * * *